US008407822B2

(12) United States Patent
Park

(10) Patent No.: US 8,407,822 B2
(45) Date of Patent: Apr. 2, 2013

(54) METHOD AND COMPOSITIONS FOR BATH

(76) Inventor: Soo Kyoung Park, East Rutherford, NJ (US)

( * ) Notice: Subject to any disclaimer, the term of this patent is extended or adjusted under 35 U.S.C. 154(b) by 1258 days.

(21) Appl. No.: 11/775,050

(22) Filed: Jul. 9, 2007

(65) Prior Publication Data

US 2008/0038375 A1 Feb. 14, 2008

Related U.S. Application Data

(63) Continuation-in-part of application No. 11/503,199, filed on Aug. 11, 2006.

(51) Int. Cl.

| | |
|---|---|
| ***A61G 9/00*** | (2006.01) |
| ***A47K 4/00*** | (2006.01) |
| ***A47K 3/00*** | (2006.01) |
| ***A47K 3/10*** | (2006.01) |
| ***E03C 1/01*** | (2006.01) |
| ***A61H 21/00*** | (2006.01) |

(52) U.S. Cl. ..... 4/451; 4/622; 4/541.1; 607/81; 607/86

(58) Field of Classification Search ..... 4/451, 619–622, 4/607, 541.1–541.3, 546, 408, 494; 607/81, 607/86

See application file for complete search history.

(56) References Cited

U.S. PATENT DOCUMENTS

| | | | | |
|---|---|---|---|---|
| 3,350,317 | A * | 10/1967 | Symes | 510/513 |
| 3,380,080 | A * | 4/1968 | Farrell | 4/622 |
| 4,179,333 | A * | 12/1979 | Braeumer et al. | 435/68.1 |
| 6,745,412 | B1 * | 6/2004 | Egeresi | 4/524 |
| 2004/0068781 | A1 * | 4/2004 | Hill | 4/222 |
| 2005/0015874 | A1 * | 1/2005 | Watanabe et al. | 4/622 |
| 2007/0224288 | A1 * | 9/2007 | Kim | 424/618 |
| 2010/0324611 | A1 * | 12/2010 | Deming et al. | 607/2 |

* cited by examiner

*Primary Examiner* — Len Tran
*Assistant Examiner* — Chee-Chong Lee
(74) *Attorney, Agent, or Firm* — Park & Associates IP Law, P.C.

(57) ABSTRACT

A bathing product for bathing comprises: a sodium hydrogen carbonate, commonly known as baking soda, being usable for softening the bathing water, removing body odor, revitalizing skin and facilitating enhanced body care or treatment, and a water sanitizing agent, being usable for effectively sanitizing the liquid and cleaning the bath apparatus without causing toxic effect to a bather for bathing in the liquid. The sodium hydrogen carbonate mixture may comprise 50-99% by weight sodium of hydrogen carbonate formed in powder form, and the water sanitizing agent may comprise about 1-10% by weight of trichloroisocyanuric acid. The bathing product may further comprise a bubbling agent to create a bubbling action for pleasure and soothing sensation for the bather.

3 Claims, 4 Drawing Sheets

METHOD AND COMPOSITIONS FOR BATH

REFERENCE TO RELATED APPLICATIONS

This application is a continuation-in-part of application Ser. No. 11/503,199 filed on Aug. 11, 2006, which is currently pending.

FIELD OF THE INVENTION

The present invention relates to bathing, and more particularly to methods for bathing and compositions thereof for applying to a bath, particularly for applying to a foot bath, in which the compositions are added in the water of a bath tub for producing a bathing liquid for foot cleansing or treatment purposes and/or to provide a relaxing experience to the bather.

BACKGROUND OF THE INVENTION

It has been well recognized that bathing provides a refreshing and relaxing experience, as well as cleansing of a human body and treatment thereof. Various types of bathing products, devices and methods of utilizing tools and therapeutic substances for bathing are known, such as those using a bathtub, a whirlpool bath or Jacuzzi, and other bathing devices. Many bath products are currently available to enhance the bathing experience. For example, bathing salts may be added to the bath water to add a pleasant aroma or to soften the bath water. There are also numerous scented oils and soaps available for use while bathing. Taking a steaming bath, such as utilizing spas or hot tubs, is also known for physiological and psychological benefits such as lowering blood pressure, relaxing muscles, relieving aches and pains, and calming the mind. Bathing also cleans the outer layer of the skin by removing surface dirt, oils, and the like.

Foot therapy and foot bathing methods are also known in connection with personal therapeutic use, for foot care, and commercial pedicure procedures. Some of such known devices are capable of producing heat to the water for enhancing blood circulation, and also water jet stream, air bubbles, and vibration in the water for facilitating massage and sensations to the body and/or feet of the bather.

Bathtubs and foot bath devices capable of producing water jet (and optionally air bubbles or stream in addition to the water jet) or whirlpool functions typically have a series of, or one or multiple circulation pipe circuits connected to the bathtub for providing water turbulence to the bathing water. After using the bathtubs, used or treated water needs to be drained as completely as possible and the tubs and bath system are to be cleaned and sanitized before next using. However, the used water as well as other impure substances stored in the water system and pipes, for example, such as particles, dirt, loose or removed skin, scum, nail particles and debris, oily substances such as body grease, and other materials, are very hard to completely remove from the water system and circulation pipes. Such impure substances in the water deposit and continue to build up in the pipes of the whirlpool system and passage sections of the water pump, etc. The used water and impure substances remaining in the bath system and pipes decay as time passes and cause serious harmful, unsanitary and toxicity concerns, typically producing unpleasant odor, germs, bacteria, or other harmful substances to human. Accordingly, cleaning, sanitization, and deodorizing of the water and bathing system, including the water circulation system, becomes a very important concern, which is particularly more important in commercial operations such as spas and pedicure operations because the bathing devices in commercial operations are used repeatedly to multiple people with different body and skin conditions.

As discussed above, sanitization and cleaning of the used water and impure substances in the bath system and circulation pipes, including water-jet tubes and various valves thereof, is a very important concern to be carefully considered and handled, particularly, in such bathtubs with whirlpool functions.

In addition, it is known in the art that chemical cleaning or detergent agents are typically used for cleaning and sanitization of the bathtubs and bathing systems after the bath is used and before a next use of the bath system. One generally accepted procedure for cleaning the bath system, particularly for those having a whirlpool bathing function, comprises: (i) used water is drained from the bath system after the bath, (ii) the bathtub is filled with clean water, (iii) suitable chemical detergent is added in the water, (iv) the whirlpool system is operated for a substantially long period of time for cleaning the system, and (v) the cleaned water with detergent is drained off. This cleaning procedure is repeated frequently, preferably after each bathing operation. Accordingly, this procedure requires the use of excessive water for the cleaning along with a substantial time and electrical energy consumption for the cleaning operations, in addition to the normal bathing operations.

SUMMARY OF THE INVENTION

Accordingly, in consideration to handle or overcome aforementioned and other shortcomings of the prior art, the present invention is directed to novel methods for bathing, in particular for foot bathing, and compositions to be used for the foot bathing.

More specifically, the present invention is directed to novel methods for bathing, particularly for foot bathing, in a beneficial bathing liquid as well as for subsequent cleaning and sanitizing (including deodorizing) of the bathing system including used water in the system, and the bathtub and circulation pipes, etc. The present invention is also directed to methods for foot bath and its compositions for producing a bathing liquid in which the sanitization is to be performed during the normal bathing operations without using harsh chemical cleaning substances. As the primary sanitization of the bath system according to the present invention is performed during the normal bathing operations, it can eliminate or at least substantially reduce the time-consuming, subsequent cleaning operations known in the conventional cleaning procedures. The methods and compositions of the invention may further enhance advantageous foot cares and treatments thereof, and cleansing of the feet for the users with the bathing compositions and also providing relaxing and refreshing bathing experiences to the users.

According to one aspect of the invention, a bathing product for use with a bath apparatus for bathing, comprises: a sodium hydrogen carbonate, commonly known as baking soda, being usable for softening the bathing water, removing body odor, revitalizing skin and facilitating enhanced body care or treatment, and a water sanitizing agent, being usable for effectively sanitizing the liquid and cleaning the bath apparatus without causing toxic effect to a bather for bathing in the liquid. The sodium hydrogen carbonate mixture preferably comprises 50-99% by weight sodium of hydrogen carbonate formed in powder form, and the water sanitizing agent preferably comprises about 1-10% by weight of trichloroisocyanuric acid.

According to another aspect of the invention, a method of foot care for a bather comprises: providing a water container partially filled water ranging from 3-7 gallons therein; adding sodium hydrogen carbonate to the water, adding a water sanitizing agent for sanitizing without causing toxic effects to the bather, preferably chlorine based agent such as trichloroisocyanuric acid, placing the feet of the bather in the liquid mixture for bathing; and, removing the dissolved liquid from the water container. According to one preferred embodiment, the sodium hydrogen carbonate mixture comprises 50-99% by weight of sodium hydrogen carbonate, and the water sanitizing agent preferably comprises about 1-10% by weight of trichloroisocyanuric acid, wherein 10-50 grams of baking soda, and 0.2-2.0 grams of trichloroisocyanuric acid are added to 5 gallons of water. According to another embodiment of the invention, it is preferable that about 20 grams of baking soda and about 0.5 grams of trichloroisocyanuric acid is added to 5 gallons of water to make the dissolved liquid mixture.

DETAILED DESCRIPTION OF THE INVENTION

With reference to the drawings, a bath apparatus, in particular a foot bath apparatus or pedicure system, methods of foot bathing and pedicure treatments, and compositions for that are described and illustrated herein according to the principles of the invention. Even though the present invention is particularly described in connection with pedicure or foot bathing systems and related methods thereof, it is not limited thereto and may be applied to beauty care applications and bathing for the entire body of a user.

Figure 1:
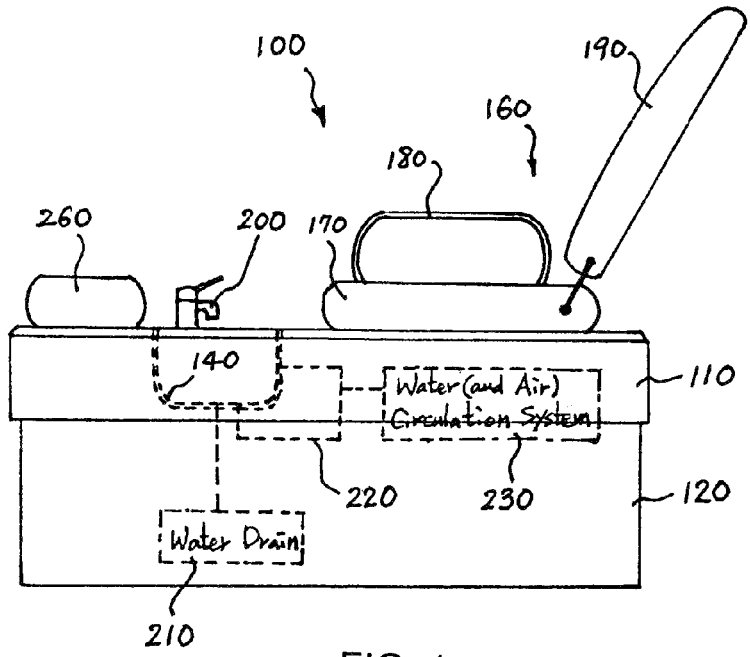
FIG. 1 is a side schematic representation of a foot bath apparatus or so-called pedicure treatment system, constructed according to the principles of the present invention.
Figure 2:
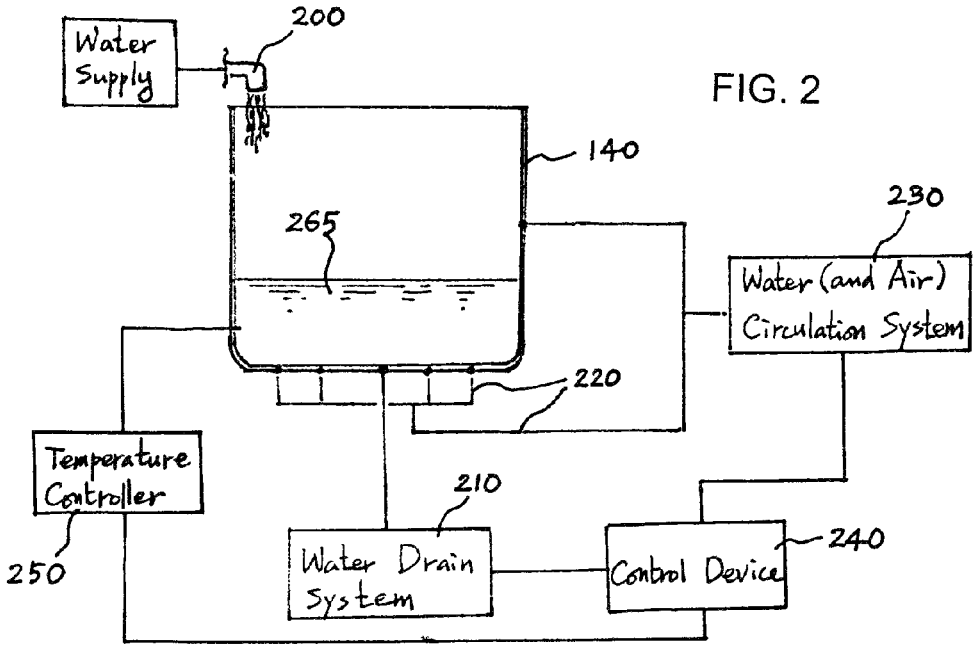
FIG. 2 is a schematic diagram of a portion of the foot bath apparatus of FIG. 1, illustrating the bathtub is being filled with hot water before performing the foot bath.

Referring to FIGS. 1 and 2, the foot bath apparatus or so-called pedicure treatment system 100 of the present invention is depicted herein as one way of example for illustrating the principles of the invention, in which the apparatus can be suitably used for commercial pedicure operations and as well as personal foot care uses at home. However, the foot care and pedicure methods and compositions described in this invention disclosure can also be used with other conventional bathing devices of known type, or with other pedicure and foot care devices.

The foot bath apparatus or pedicure system 100 typically includes, a housing 110 having an upper housing portion 110 and a lower housing portion 120. A bathtub or water receptacle 140 is disposed at a suitable exposed location on the upper housing portion 110. A user occupying seat 160 (preferably having a bottom cushion 170, a pair of arm rests 180, and back support 190) is conveniently disposed at the upper housing portion 110 for facilitating immersion of their feet in bathtub 140 while the bather is seated on the seat 160. One or plural water supply devices with water faucets 200 are provided for supplying water to the bathtub 140. Although system 100 could be operated in a quiescent or non-jetted mode, it is generally preferred that a recirculation system is provided to move fluids within the bathtub 140 with a jet action of water and/or air stream when it is desired to use, as will be further described later in detail. Mechanical and plumbing systems for re-circulation and other operations are located within lower housing 110. A water drain or receptacle outlet 210, a re-circulating circuit 220, and a water (and optionally air as well) circulation system 230 operating under control of a control device 240 (such as micro-computer or other programmable control device) are also provided for appropriate operation of the bath apparatus and the whirlpool system thereof. The apparatus 100 may also includes a temperature controller 250 for heating and maintaining the water in the bathtub to a suitable temperature for bathing. The apparatus 100 further preferably includes one or a pair of foot rests 260 at suitable location for placing the feet of the bather thereon whenever desired during the bathing operation.

Referring to FIGS. 2-8, the bathing operation using the apparatus 100 and composition of the bathing product of the invention are described herein. The apparatus 100 is to be used with the bathing product of the invention, which includes typically two bathing packages provided preferably in the form of a cardboard box or other suitable container, namely a first package for retaining sodium hydrogen carbonate material and water sanitizing agent and a second package for retaining a bubbling agent material. The sodium hydrogen carbonate and water sanitizing agent are preferably in the form of powder or particles, whereas the bubbling agent is preferably in the form of a tablet or a pill. These materials further include various utilities and functions to be described later in detail. Operating instructions are typically printed on the side of the packaging and as well as on a separate instruction sheet packaged within the product package. The actual amount in the packages can be varied in a manner suitable either for a single use or for multiple uses for using with exact measuring in each use.

According to one preferred embodiment, the first package of the present invention comprises about 50-99% by weight of sodium hydrogen carbonate (which is also known as sodium bicarbonate or baking soda) and about 1-10% by weight of water sanitizing agent as major ingredients thereof. The water sanitizing agent is selected from a group, which consists of a chlorine based sanitizer, a bromine based sanitizer, and a biguanide based sanitizer. According to one preferred embodiment, the water sanitizing agent is composed of either trichloroisocyanuric acid or monochloramine such as chloramine-T. This agent facilitates sanitization of the liquid of the foot bath without adding toxicity to the bather. Germs, bacteria, and other infective substances in the liquid can effectively be killed or disinfected by such addition of chloramines or chlorine products known to be used as disinfectants. Thus, by application of the product containing sodium hydrogen carbonate (i.e., baking soda) and chlorine-based or other sanitizing materials, the dissolved liquid can become safer and disinfected. This is especially beneficial for commercial pedicure operations in which the bath apparatus is frequently used to multiple clients.

According to another preferred embodiment, the first package may further comprise, in addition to sodium hydrogen carbonate and chlorine-based sanitizing agent, about 5-50% by weight of organic or inorganic materials for facilitating beauty care, treatments for the human body and feet, cleansing of the skin, or adding refreshing and relaxing experience. According to another preferred embodiment, the first package is selected to include about 50-99% by weight of sodium hydrogen carbonate, 1-10% by weight of water sanitizing agent, and about 1-40% by weight of herbal or plant extracts or derivatives thereof known to be useful for enhancing skin care, and other additives such as small amount of fragrance and coloring agent, etc. Candidates for the plant extracts or derivatives thereof include, without limitation thereto, aloe vera, cucumber, olive, rosemary, lavender, thyme, green tea, black tea, and mint.

Among the ingredients, sodium hydrogen carbonate functions for facilitating sanitization and deodorization of the liquid and also for cleaning of the bath apparatus including the bathtub and drain pipes without causing any toxic or harmful effect to a bather for bathing in the liquid. Therefore, the bath liquid containing sodium hydrogen carbonate and sanitizing agents can effectively sanitize, clean, and deodorize the bathing liquid and the bath apparatus during the normal pedicure or bathing operations without using harsh chemical cleaning substances as conventionally used. Moreover, sodium hydrogen carbonate added in the bathtub water may also be beneficial to the bather. For example, it also functions for deeply cleansing the skin by removing scum, body oil, and grease from the skin and sweat capillaries, absorbing calcium, magnesium and metallic material from the water and transforming the acidified water to the neutral bathing water having enhanced pH value beneficial to the skin, removing bad smells and deodorizing the skin and bathing water, relieving the irritated skin, relieving sufferings from irritating atopic skin and sunburned skins, and prickly heat in the skin, and enhancing blood circulation in the skin. Accordingly, the sodium hydrogen carbonate components in the bathing water may provide various skin care and therapeutic benefits while without irritating or giving harmful effects to the bather.

In one example, the first package is selected to include about 50-99% by weight sodium hydrogen carbonate, about 0.5-8% by weight of water sanitizing agent, about 1-20% by weight aloe vera extract, about 1-20% by weight cucumber extract, about 0.1-3% by weight of fragrance, and about 0.1-3% by weight of coloring agent. In another example, the first package is selected to include about 50-95% by weight sodium hydrogen carbonate, about 0.5-8% by weight of water sanitizing agent, about 1-30% by weight of aloe vera or cucumber extract, about 1-15% by weight urea, about 0.1-3% by weight of fragrance, and about 0.1-3% by weight of coloring agent. Among the plant extracts, aloe vera extract typically obtained from its leaves and cucumber extract are useful for advantageous skin care, for example, promoting healing of damaged or heat-burned skin, and urea (also known as carbamide) is useful for softening and cleansing the skin. The amount of the herbal or plant extracts may be varied in a great degree, and that of the fragrance and coloring agent may be eliminate completely. Moreover, other additional ingredients of suitable amounts about such as L-mentol, vitamin A, vitamin C, and vitamin E, may be added for enhancing advantageous skin care and/or refreshing experience. Each additional ingredient is preferably 0.1-5% by weight, but can be varied.

The second package of the invention is preferably formed in the form of tablets or pills, and comprises suitable amounts of a bubbling agent. According to one preferred embodiment, the bubbling agent of the present invention comprises of citric acid. The bubbling agent creates bubbling action within the water of the footbath, which functions to relax and give a soothing sensation to the bather.

Moreover, the above-mentioned other ingredients of the first package, such as fragrance, coloring agent, urea, L-mentol, vitamin A, vitamin C, and vitamin E, may also be added in the second package for enhancing advantageous skin care or refreshing experience. Alternatively, these ingredients may be added in the second package instead of in the first package.

FIG. 2 illustrates the process of filling bathtub 140 with water 265 by a faucet 200, before bathing of the feet therein. Bathtub 140 typically is filled with water 265 to about one third or one fourth the capacity of the bathtub for foot bathing, namely approximately three to seven gallons of water, before the addition of the materials as described above. A ratio of five gallons of hot water is used for approximately 10-50 grams of sodium hydrogen carbonate, and either 0.2-2 grams of trichloroisocyanuric acid, or 0.4-3 milliliters of chloramine-T, in preference of the user. Other amounts of water may be used depending on the size of the bathtub and so long as this water to ingredient material ratio range is maintained. The water may be cold water or warm water of desirable temperature. In addition, the temperature controller 250 of the system can maintain a suitable temperature of the bath water.

Figure 3:
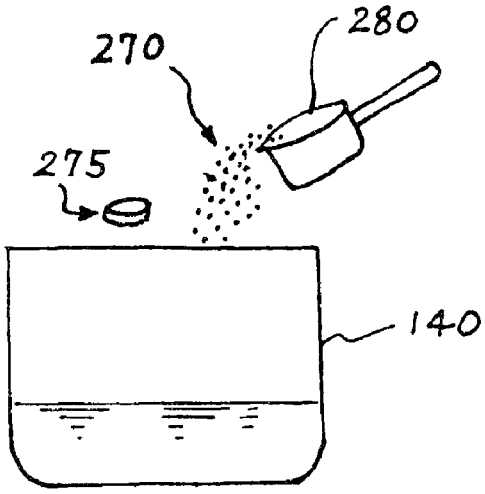
FIG. 3 is a schematic diagram of a portion of the foot bath apparatus of FIG. 1, illustrating the process of adding sodium hydrogen carbonate, water sanitizing agent and bubbling agent to the bathtub filled with water.
Figure 4:
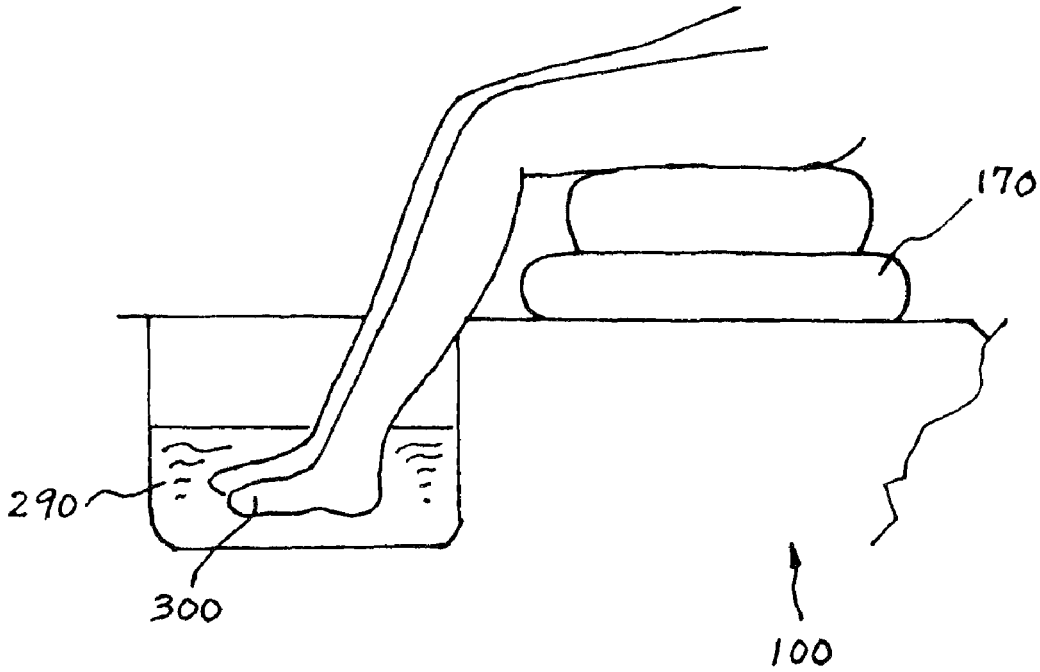
FIG. 4 is a schematic diagram of a portion of the foot bath apparatus of FIG. 1, illustrating the process that the feet of a user is seated in the bathtub containing the gelatinous mixture.

FIG. 3 is a schematic view illustrating a portion of the foot bath apparatus and the process of applying a first package 270, composed essentially of sodium hydrogen carbonate and water sanitizing agent, to the bathtub filled with water 265. The first package 270 of between about 10 and 55 grams, which may be varied depending on preference of the bather, is filled in a suitable measuring cup 280 and added to tub 140 filled with water 265 after the tub reaches three to seven gallons of water. The material/water mixture is then gently stirred to facilitate even mixing of the material throughout the water to form the bathing mixture 290 (FIG.4). As described above, the composition of sodium hydrogen carbonate and water sanitizing agent is used for sanitization, cleaning and deodorization of the dissolved liquid and also of the bath tub 140 and water circulation pipes 220 (FIG. 2) without causing a toxic effect to a bather for bathing in the liquid. The sodium hydrogen carbonate component further enhances therapeutic or body care benefits for the bather as discussed above.

With continued reference to FIG. 3, a second package, typically composed of a bubbling agent and other ingredients described above, is opened and the materials 275 in the package is added to the tub 140 filled with the bath liquid. The bubbling agent creates bubbling action within the water of the footbath, which functions to relax and give a soothing sensation to the bather.

Now in reference to FIG. 4, a foot bathing process is illustrated herein. A bather is seated in the seat 160 and the feet 300 of the bather are placed in the bathing liquid 290 of the tub. The feet 300 of the bather are substantially or at least partially submerged in bathing mixture 290. Once the feet of the bather is seated in the bathtub the level of the bathing mixture rises due to the volume of the feet within the tub, and the bathing mixture substantially covers the feet of the bather. The feet typically will remain substantially or partially submerged in bathing mixture 290 for approximately five to ten minutes or longer depending on the preference and desire. The whirlpool function of the bath apparatus 100 may be turned on throughout the entire bathing process or only for some of the process to be described later in connection with FIGS. 6-7. During the time the feet are soaking in tub 110, the bathing mixture cleanses the sweat and toxins from below the uppermost surface layers of the bather's skin. The temperature of the mixture 290 may be maintained by the temperature controller 250 to a suitable bathing temperature. With the feet submerged in the bathing mixture, the bather may experience entirely refreshing and relaxing feelings while the feet are cleansed deeply. Moreover, when the first package 270 includes materials derived from various useful plant extracts described above (e.g., aloe vera and cucumber), the beneficial ingredients of the plants can further treat the skin of the bather.

Figure 5:
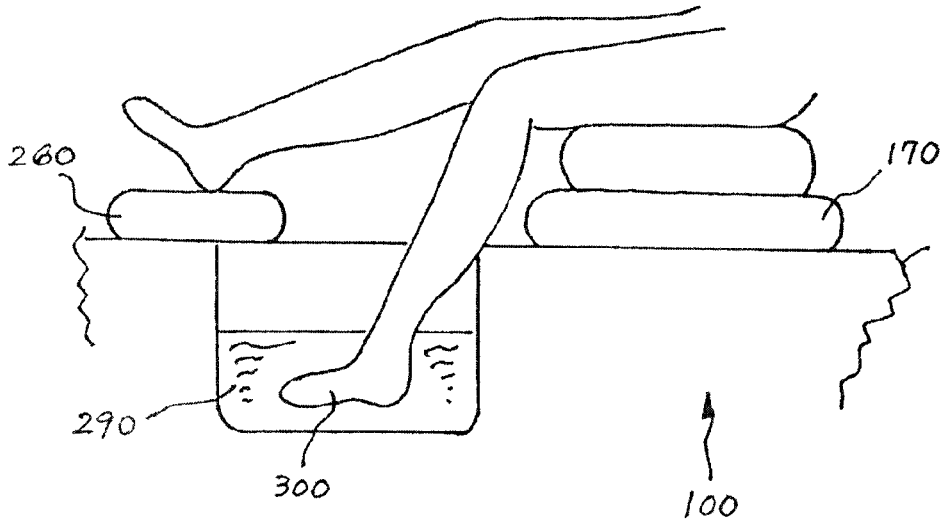
FIG. 5 is a schematic diagram of a portion of the foot bath apparatus as shown in FIG. 4, illustrating the process that one foot of the user is seated in the bathtub of the mixture and the other one is placed on a side foot support of the foot bath apparatus for pedicure or foot care services.

FIG. 5, an optional foot care process in addition to the foot bathing process described above with FIG. 4, is described herein. This optional process is particularly suitable for commercial pedicure operations and personal foot care operations as well. After the feet of the bather have been soaked for the desired amount of time, one foot 300 of the bather is exited from the bathing mixture 290 and placed on the foot rest 260. Then, the foot on the foot rest 260 is massaged and treated by various known methods. For example, one may squeeze the foot with hands, press certain spots of the foot with fingers or other massaging devices, or utilize a foot vibrator for heath treatments. In addition, conventional commercial pedicure treatment procedures may optionally further be performed onto the foot, such as filing toenails, removing old polish on toenails and applying new polish, removing cuticles and callous in toes, applying steam to the foot, and massaging with oil, etc. However, such optional pedicure treatments are typically to be performed in a later process to be described in connection with FIG. 7. Then, the treated foot 300 is returned to the bathing mixture 290, and the other foot is exited from the bathing mixture 290 and placed on the foot rest 260. Similar operations and treatments described above are applied onto the other foot. This foot care process can last approximately about five to ten minutes or longer depending on the preference and desire of the bather. Moreover, after this process the two feet of the bather can be seated again in the bathing mixture 290 for a suitable period of time, as shown in FIG. 4, if desired.

Figure 6:
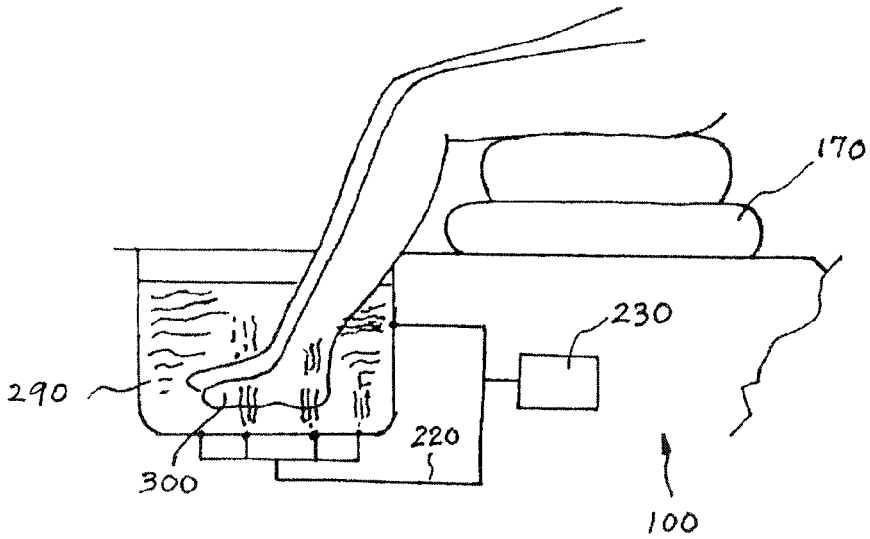
FIG. 6 is a schematic diagram of the foot bath apparatus as shown in FIG. 4, illustrating the process that the feet of the user is seated for further bathing treatments in the bathtub filled with the hot water added while operating the whirlpool function of the apparatus.

Referring to FIG. 6, the feet 300 of the bather is now seated for further bathing treatments in the bathtub 140. The whirlpool function of the apparatus 100 is preferably turned on during the bathing, and the liquid is recirculated through the circulation circuits 220 and water stream (optionally with air bubbles or stream) is repeatedly injected onto the feet. This further enhances the bathing experience, while also sanitizing and deodorizing the bathing liquid in the system and the bath apparatus 100 including the bathtub 140, circulation circuits 220, and circulation system 230, with the aid of sodium hydrogen carbonate and the water sanitizing agent such as trichloroisocyanuric acid or chloramine-T, as discussed above. The feet and lower legs are seated and submerged in whirlpool bath for approximately five to twenty minutes or longer depending on the preference and desire.

Figure 7:
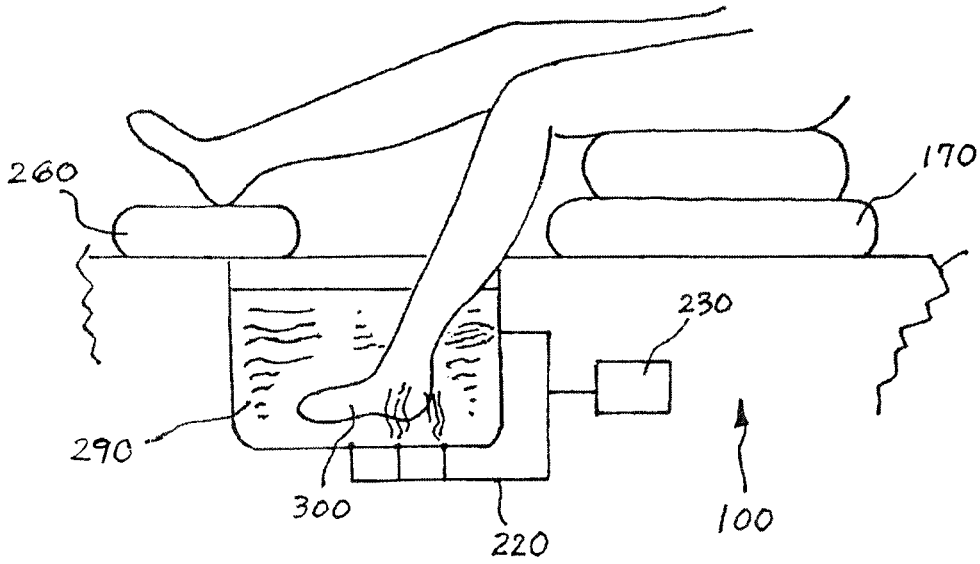
FIG. 7 is a schematic diagram of the foot bath apparatus as shown in FIG. 6, illustrating the process that one foot of the user is seated in the bathtub of the tub and the other one is placed on a side foot support of the foot bath apparatus for pedicure or foot care services.

During this bathing operation, each foot may be exited in turn and placed on the foot rest 260 as illustrated in FIG. 7. Further pedicure or foot care operations such as massaging and pressing the feet, vibrating with a vibrator, and conventional commercial pedicure treatments such as filing toenails, removing old polish on toenails and applying new polish, removing cuticles and callous in the toes, applying steam to the foot, and massaging with oil or lotion, etc. may be applied. These optional pedicure treatments can be performed before as described in connection with FIG. 5. However, it is more preferable that these treatments are to be performed at the present process.

Figure 8:
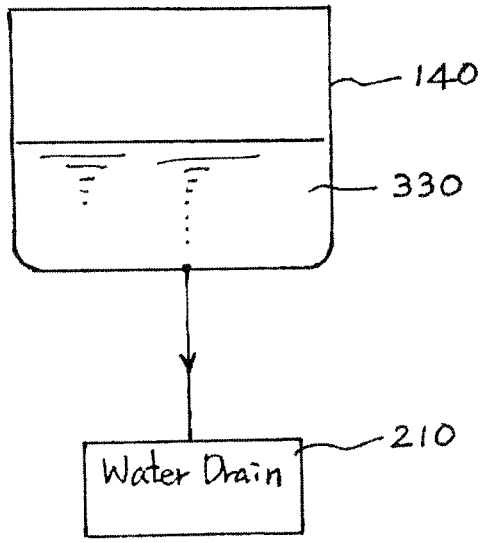
FIG. 8 is a schematic diagram of the foot bath apparatus as shown in FIG. 6, illustrating the process that the mixture is being drained through a water drain system of the apparatus.

The feet of the bather are cleaned with fresh water and soap, and the bathing and pedicure operation ends. Then, as shown in FIG. 8, the bathing liquid in the bathtub is drained from the apparatus 100. After draining of the tub, it may be preferable that the tub 140 is filled with fresh warm water with the faucet 200 (optionally with commercial detergents added to the water depending on the cleaned condition of the apparatus 100), and the whirlpool function of the apparatus 100 is operated for a short period of time (e.g., for a few minutes) and the water circuits 220 and water circulation system 230 is washed off with the warm water to clean the system. However, as described above, because sodium hydrogen carbonate (and optionally with chloramine) in the second material cleans, sanitizes and deodorizes the liquid and the water system of the apparatus 100 during the above-described normal bathing operations, this additional cleaning process may be entirely eliminated, or the time period of the cleaning operation may be substantially reduced comparing to the conventional cleaning process which typically requires a substantially long period of time while applying harsh chemical detergent in the water. In addition, according to the invention, such conventional application of harsh chemical detergent may be entirely eliminated or the amounts can be substantially reduced.

While preferred embodiments of the present invention have been shown and described, it will be apparent to those skilled in the art that many changes and modifications may be made without departing from the invention in its broader aspects. The appended claims are intended to cover, therefore, all such changes and modifications as fall within the true spirit and scope of the invention.

What is claimed is:

1. A bathing product for foot care by applying to a bathing liquid contained in a bath apparatus for foot bath, the bath apparatus having a water container connected to a water circulation system, the bathing product consisting:

about 50-99% by weight of sodium hydrogen carbonate for facilitating cleaning and deodorizing the bathing liquid and the bath apparatus without causing a toxic effect to a bather for bathing in the bathing liquid, and also for skin care and therapeutic benefits to the bather;

about 1-10% by weight of a water sanitizing agent for sanitizing the bathing liquid and for sanitizing and cleaning a water passage of the bath apparatus upon circulation of the bathing liquid using the water circulation system without causing toxic effect to the bather for bathing in the liquid, the water sanitizing agent selected from a group consisting of a bromine based sanitizer, a biguanide based sanitizer, and a chlorine based sanitizer, said chlorine based sanitizer selected from a group consisting of chloramine, chloramine-T, trichloroisocyanuric acid, and sodium dichloroisocyanate;

about 1-40% by weight of herbal or plant extracts, said herbal or plant extracts comprise about 1-20% by weight of aloe vera extract and about 1-20% by weight of cucumber extract, and the bathing product further comprises about 0.1-3% by weight of fragrance and about 0.1-3% by weight of coloring agent; and a bubbling agent to create a bubbling action for pleasure and soothing sensation for the bather, the bubbling agent including citric acid and formed in tablet form.

2. A bathing product for foot care by applying to a bathing liquid contained in a bath apparatus for foot bath, the bath apparatus having a water circulation circuit coupled thereto for circulating or providing water stream to a bather, the bathing product consisting:

about 50-99% by weight of sodium hydrogen carbonate for sanitizing, cleaning, and deodorizing the bathing liquid without causing a toxic effect to a bather for bathing in the bathing liquid, and also for sanitizing, cleaning, and deodorizing the bath apparatus and the water circulation circuit coupled thereto upon circulation of the bathing liquid;

about 1-10% by weight of a water sanitizing agent for sanitizing or cleaning the bathing liquid and the bath apparatus without causing toxic effect to the bather for bathing in the liquid, the water sanitizing agent selected from a group consisting of a bromine based sanitizer, a biguanide based sanitizer, and a chlorine based sanitizer, said chlorine based sanitizer selected from a group consisting of chloramine, chloramine-T, trichloroisocyanuric acid, and sodium dichloroisocyanate;

about 1-40% by weight of herbal or plant extracts, said herbal or plant extracts comprise about 1-30% by weight of aloe vera or cucumber extract, and the bathing product further comprises about 1-15% by weight of urea, about 0.1-3% by weight of fragrance, and about 0.1-3% by weight of coloring agent; and a bubbling agent to create a bubbling action for pleasure and soothing sensation for the bather.

3. A method of foot care for a bather using a bathing substance, consisting the method steps of:

providing a bath apparatus with a water container connected to a water circulation system;

partially filling water in the water container;

adding a bathing product to the water, the bathing product consisting essentially of about 50-99% by weight of sodium hydrogen carbonate and about 1-10% by weight of a sanitizing agent, said sanitizing agent selected from a group consisting of a bromine based sanitizer, a biguanide based sanitizer, and a chlorine based sanitizer, said chlorine based sanitizer selected from a group consisting of chloramine, chloramine-T, trichloroisocyanuric acid, and sodium dichloroisocyanate, for sanitizing the water and a water passage of the bath apparatus without causing toxic effects to the bather, the bathing product further including about 1-40% by weight of herbal or plant extracts;

adding a bubbling agent in the water for increasing the pleasure and bathing sensation for the bather;

placing the feet of the bather in the water for bathing;

circulating the water using the water circulation system such that a water passage of the bath apparatus can be sanitized by the sanitizing agent of the bathing product; and draining the used water from the water container through a bath drain of the bath apparatus, wherein said bathing in the water is performed while circulating the water with the water circulation system.

* * * * *